US007578427B2

(12) United States Patent
Durnin

(10) Patent No.: US 7,578,427 B2
(45) Date of Patent: Aug. 25, 2009

(54) CARTON WITH A LOAD-BEARING DIVIDER SHELF

(75) Inventor: Cary K. Durnin, Olathe, KS (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 689 days.

(21) Appl. No.: 11/154,889

(22) Filed: Jun. 16, 2005

(65) Prior Publication Data

US 2006/0283926 A1 Dec. 21, 2006

(51) Int. Cl.
*B65D 25/01* (2006.01)
*B65D 5/32* (2006.01)

(52) U.S. Cl. ..... 229/120.32; 229/120.21; 229/122.24; 229/122.26

(58) Field of Classification Search ..... 229/120.21, 229/120.24, 120.26, 120.19, 122.23, 122.24, 229/120.28, 120.29; 220/529, 530; 206/743
See application file for complete search history.

(56) References Cited

U.S. PATENT DOCUMENTS 2,844,294 A * 7/1958 Williams ..... 229/120.1
3,092,300 A * 6/1963 Johnson ..... 229/120.29
3,115,290 A * 12/1963 Byassee ..... 206/591
3,236,433 A 2/1966 Barrett et al.
3,258,188 A * 6/1966 Houston ..... 229/120.33
3,921,893 A * 11/1975 Randle, Jr. ..... 229/120.03
3,963,169 A 6/1976 Gardner
4,157,157 A 6/1979 Young
4,779,737 A * 10/1988 Umehara et al. ..... 229/120.012
6,499,655 B1 * 12/2002 Moen ..... 229/120.24
2005/0023331 A1 2/2005 Hirschey

* cited by examiner

*Primary Examiner*—Gary E Elkins
*Assistant Examiner*—Christopher Demeree
(74) *Attorney, Agent, or Firm*—Joel Charlton

(57) ABSTRACT

Disclosed are blanks for divider shelves for erecting into load-bearing divider shelves for use in cartons. In one embodiment, a divider blank for erecting into a load-bearing divider shelf having a length and width is disclosed. The divider blank comprises two center supports that are foldably attached by a fold line extending in a lengthwise direction. Each center support has two ends in which each end is foldably attached to an end support. Each end support has a top and bottom and is attached to an angular slot flap by a fold line extending between the top and bottom of the end support. Each angular slot flap has a locking slot in the mid-section between the top and bottom of the flap. The divider shelves erected from the blanks and the carton with the divider shelves installed are also disclosed.

17 Claims, 7 Drawing Sheets

CARTON WITH A LOAD-BEARING DIVIDER SHELF

TECHNICAL FIELD

This invention relates generally to cartons with a load-bearing divider shelf that are useful in the packaging of products such as poultry, beef, produce, and liquid-filled containers.

BACKGROUND OF THE INVENTION

Prior art cartons have been used that include a horizontal divider shelf and a vertical center divider that provides some support for the center of the horizontal divider shelf. With this configuration, other means are needed to provide support for the ends of the horizontal divider shelf to prevent it from collapsing when items are placed on it. For example, locking tabs that extend horizontally from the ends of the horizontal divider shelf have been used to engage horizontal slots formed in the sides of the container. This arrangement provides insufficient load-bearing support for the ends of the horizontal divider shelf. As such, it has not proven to be effective, especially where there is a need for a load-bearing shelf that can support heavy products, such as hams, other meat products or containers of liquid.

Such a prior art carton with horizontally extending tabs on the divider shelf that engage horizontally extending slots formed in the sides of the carton is illustrated and described in relation to FIGS. 12 and 13. FIG. 12 is a perspective view of a divider shelf 131 placed on top of a wrap-around closure 143, and FIG. 13 is a cross-sectional view of the carton 130 along line 13-13 as shown in FIG. 12. Carton 130 has a length 167 and width 169.

Divider shelf 131 has two center supports 145, 147, which are foldably attached by a fold line 132 extending in a lengthwise direction 167. Each center support 145, 147 has two ends, with each end being foldably attached to an end support 171, 173. The divider shelf 131 further has a shelf 133 with two leaves 133A, 133B, with each leaf being foldably attached to each center support 145, 147 by a fold line 149, 151, respectively. Each leaf is attached to two locking tabs 135, 137, 139, 141 that extend horizontally through locking slots 155, 157, 159, 161, respectively, of side panels 163, 165 of the wrap-around closure 143. As seen in FIG. 13, the center supports 145, 147 bisect the lower portion of the carton 130 into two lower compartments 175, 177, and the shelf leaves 133A, 133B form an upper compartment 179. A disadvantage of this configuration is that when a downward force 181 is applied to the shelf 133, the horizontal extending locking tabs 135, 137, 139, 141 provide little load-bearing support for the shelf 133. Thus, it can be seen that there is a need for a carton containing a shelf that has sufficient load-bearing capability to hold heavy items such as poultry, beef, produce and liquid filled containers.

SUMMARY OF THE INVENTION

Disclosed are blanks for divider shelves for erecting into load-bearing divider shelves for use in cartons. In one embodiment, a divider blank for erecting into a load-bearing divider shelf having a length and width is disclosed. The divider blank comprises two center supports that are foldably attached by a fold line extending in a lengthwise direction. Each center support has two ends in which each end is foldably attached to an end support. Each end support has a top and bottom and is attached to an angular slot flap by a fold line extending between the top and bottom of the end support. Each angular slot flap has a locking slot in the mid-section between the top and bottom of the flap.

The divider blank further includes a divider shelf with two leaves, with each leaf being attached to a center support by a fold line that extends at least a substantial distance of the length of the center support and in a direction that is substantially parallel to the fold line between the two center supports. Each leaf shelf is foldably attached to a locking flap with two ends having a locking tab that is capable of engaging the locking slot.

This divider shelf blank can be erected into a load-bearing divider shelf by folding the blank along the various fold lines and manipulating the various panels and flaps into the proper positions.

In another embodiment, among others, the above load-bearing divider shelf can be modified by adding a side support flap to each angular slot flap. Inclusion of this side support flap is desirable as it adds to the strength of the load-bearing divider shelf. In another modification, a horizontal support flap can be added that is foldably attached to the locking flap.

It will be recognized that both of these embodiments form one compartment on the upper portion and two compartments on the lower portion of the load-bearing divider shelf.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Disclosed are cartons having load-bearing divider shelves and blanks for erecting into load-bearing divider shelves for use in cartons. In one embodiment, a divider blank for erecting into a load-bearing divider shelf for use in a carton comprises a divider shelf that is foldably attached to center supports. The divider shelf extends at least a substantial distance of a length of the center supports and in a direction at least substantially parallel to a fold line between the two center supports. Each leaf of the divider shelf is foldably attached to a locking flap, which has an end with a locking tab. The cartons and blanks disclosed can be constructed of single ply paperboard. For heavier loads, corrugated paperboard is preferred.

Exemplary cartons and blanks are discussed with reference to the figures. Although the cartons and blanks are described in detail, the cartons and blanks are provided for purposes of illustration only and various modifications are feasible.

Figure 1:
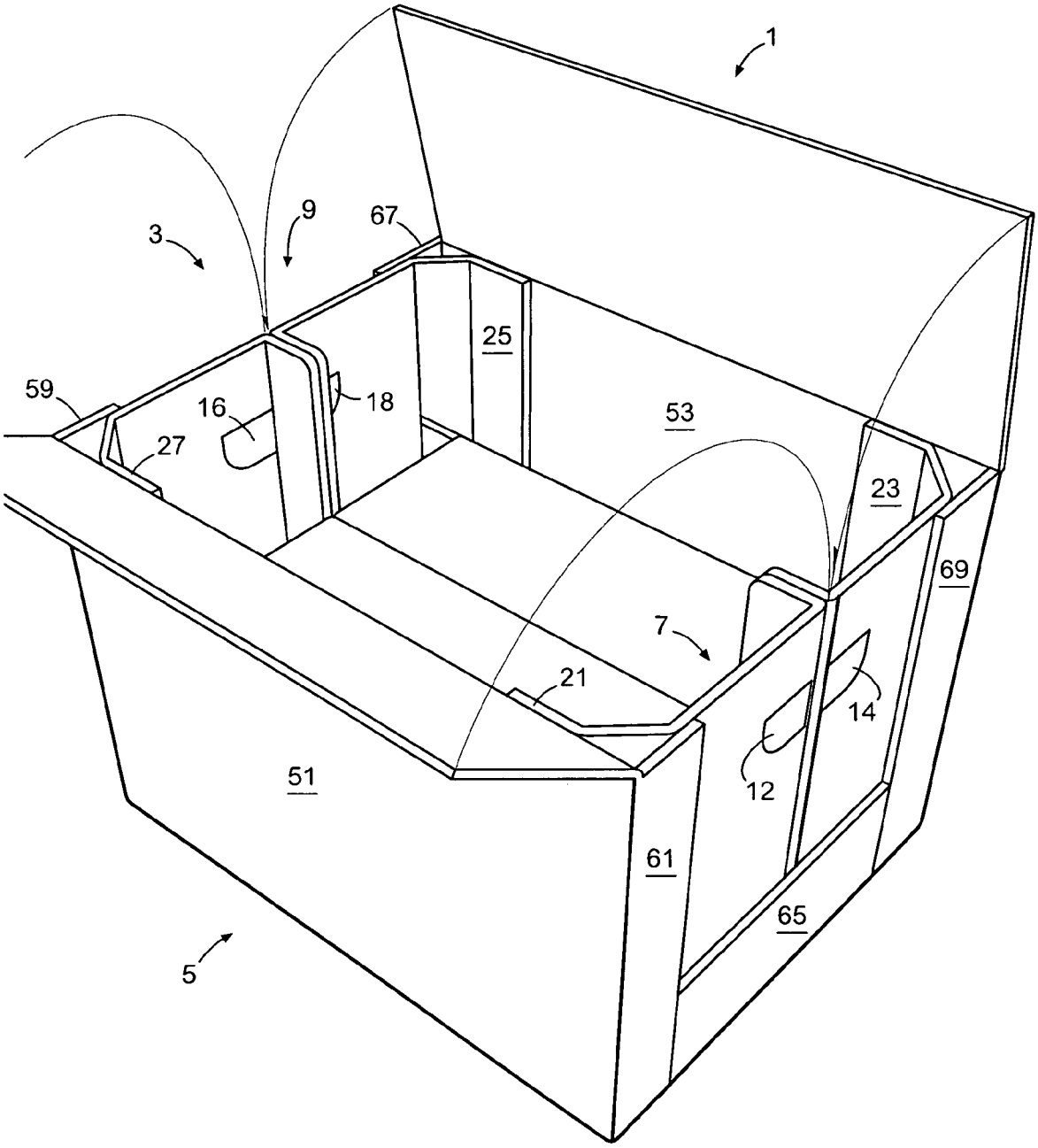
FIG. 1 is a perspective view of an embodiment of a carton with a load-bearing divider shelf with the carton in an open position.

Referring now in more detail to the figures in which like reference numerals identify corresponding parts, FIG. 1 is a perspective view of an embodiment of a load-bearing divider shelf in a carton that has been opened at the top. The carton 1 includes a load-bearing divider shelf 3 and a wrap-around closure 5. The wrap-around closure 5 is attached to the load-bearing divider shelf 3 by, for example, gluing or stapling bottom strips 63 (shown in FIG. 3), 65, side strips 59, 61, 67, 69, to end supports 7, 9, and side panels 51, 53 to side support flaps 21, 23, 25, 27. Handles 12, 14, 16, 18 are formed in the end supports 7, 9 of the load-bearing divider shelf 3, respectively.

Figure 2:
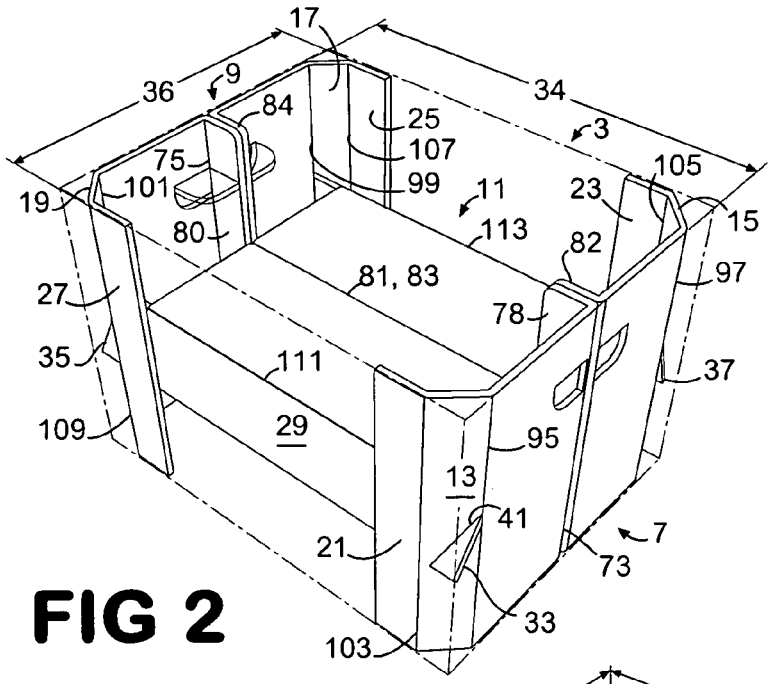
FIG. 2 is a perspective view of an embodiment of a load-bearing divider shelf in the erected position as shown in FIG. 1 and showing in phantom the outline of the carton.

FIG. 2 is a perspective view of an embodiment of a load-bearing divider shelf as shown in FIG. 1 and showing in phantom the outline of the carton. The load-bearing divider shelf 3 has a length 34 and width 36 and includes a divider shelf 11 that is disposed horizontally between end supports 7, 9. The divider shelf 11 is foldably attached to center supports 85, 86 (shown in FIGS. 5 and 11) by fold lines 81, 83. The divider shelf 11 divides the carton 1 into an upper portion and a lower portion, and the center supports 85, 86 bisect the lower portion of the carton 1, which are further illustrated and described in FIG. 11.

The divider shelf 11 is attached to locking flaps 29, 31 (shown in FIG. 5) by fold lines 111, 113, respectively, which are generally parallel to the fold lines 81, 83. Each locking flap 29, 31 has two ends, each of which has a locking tab 33, 35, 37, 39 (shown in FIG. 5) that is locked in a locking slot 41, 47, 43, 45 (shown in FIG. 5) on an adjacent angular slot flap 13, 19, 15, 17, respectively.

Each of the center supports 85, 86 has two ends 78, 80, 82, 84, respectively. The ends 78, 82, 80, 84 are foldably attached to end supports 7, 9 by fold lines 73, 75, respectively. The end supports 7, 9 are foldably attached to angular slot flaps 13, 15, 17, 19 by fold lines 95, 97, 99, 101, respectively. The angular slot flaps 13, 15, 17, 19 extend between the top and bottom of the end supports 7, 9, with the angular slot flaps 13, 15, 17, 19 extending at an obtuse angle, e.g., 90 degrees or more, towards the plane of the opposing end supports 7, 9 when the load-bearing divider shelf 3 has been erected. The angular slot flaps 13, 15, 17, 19 have locking slots 41, 43, 45, 47 between the top and bottom of the flaps 13, 15, 17, 19, respectively. Preferably, the locking slots are disposed in the mid-section between the top and bottom of the flaps 13, 15, 17, 19.

Figure 6:
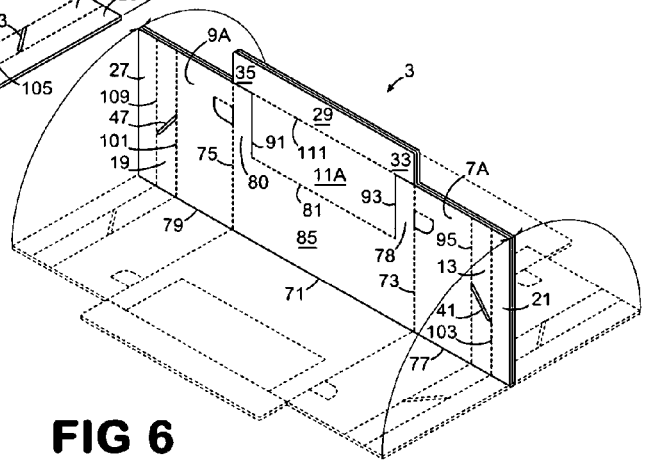

The locking slots 41, 43, 45, 47 in the angular slot flaps 13, 15, 17, 19 extend downwardly at an angle, e.g., 45 degrees, from the fold lines 95, 97, 99, 101, respectively, between the end supports 7, 9, and the angular slot flaps 13, 15, 17, 19, as further illustrated in FIG. 6. The locking flaps 29, 31 extend downwardly at least at substantially the same angle as the locking slots 41, 43, 45, 47 in the angular slot flaps 13, 15, 17, 19. The angular slot flaps 13, 15, 17, 19 are foldably attached to side support flaps 21, 23, 25, 27 by fold lines 103, 105, 107, 109, respectively. The use of the side support flaps 21, 23, 25, 27 is preferred because these flaps help support the load-bearing divider shelf 3.

Figure 3:
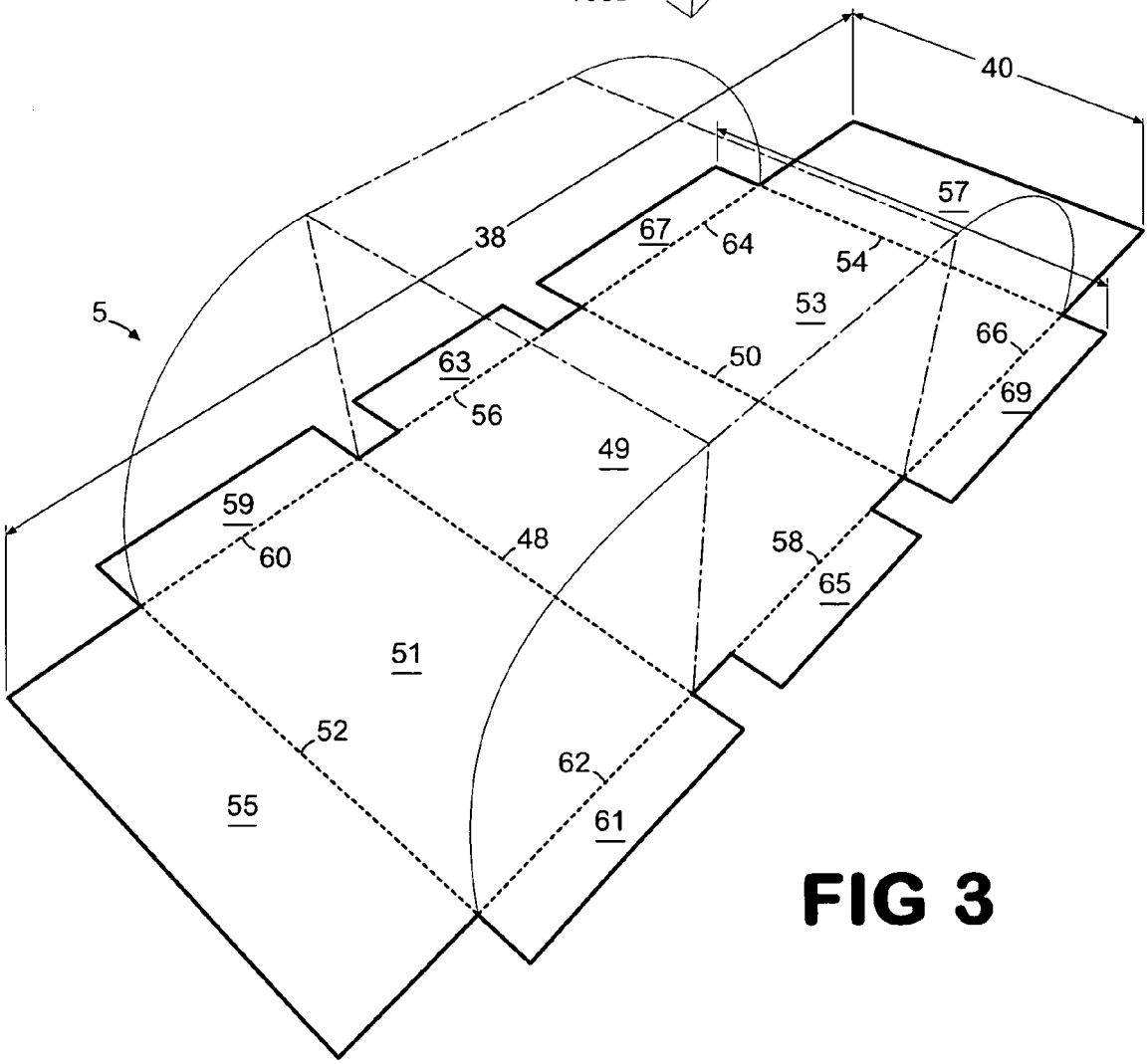
FIG. 3 is a perspective view of an embodiment of a wrap-around closure blank as shown in FIG. 1.

FIG. 3 is a perspective view of an embodiment of a wrap-around closure blank shown in FIG. 1. The wrap-around closure 5 encloses the load-bearing divider shelf 3 to form a carton 1. The wrap-around closure 5 includes a bottom panel 49, top flaps 55, 57, which form a top panel, and side panels 51, 53, each of which is connected with the bottom panel 49 and the top flaps 55, 57. The wrap-around closure 5 has a length 38 and width 40. The length 38 of the wrap-around closure 5 extends around the load-bearing divider shelf 3 in the same direction as the width 36 of the load-bearing divider shelf 3. The width 40 of the wrap-around closure 5 should be sufficient to enclose the load-bearing divider shelf 3 along its length 34. The bottom panel 49 is foldably attached to side panels 51, 53 by fold lines 48, 50, respectively. The side panels 51, 53 are foldably attached to top flaps 55, 57 by fold lines 52, 54, respectively. The bottom panel 49 and side panels 51, 53 are further foldably attached to strips 63, 65, 59, 61, 67, 69 by fold lines 56, 58, 60, 62, 64, 66, respectively.

Figure 4:
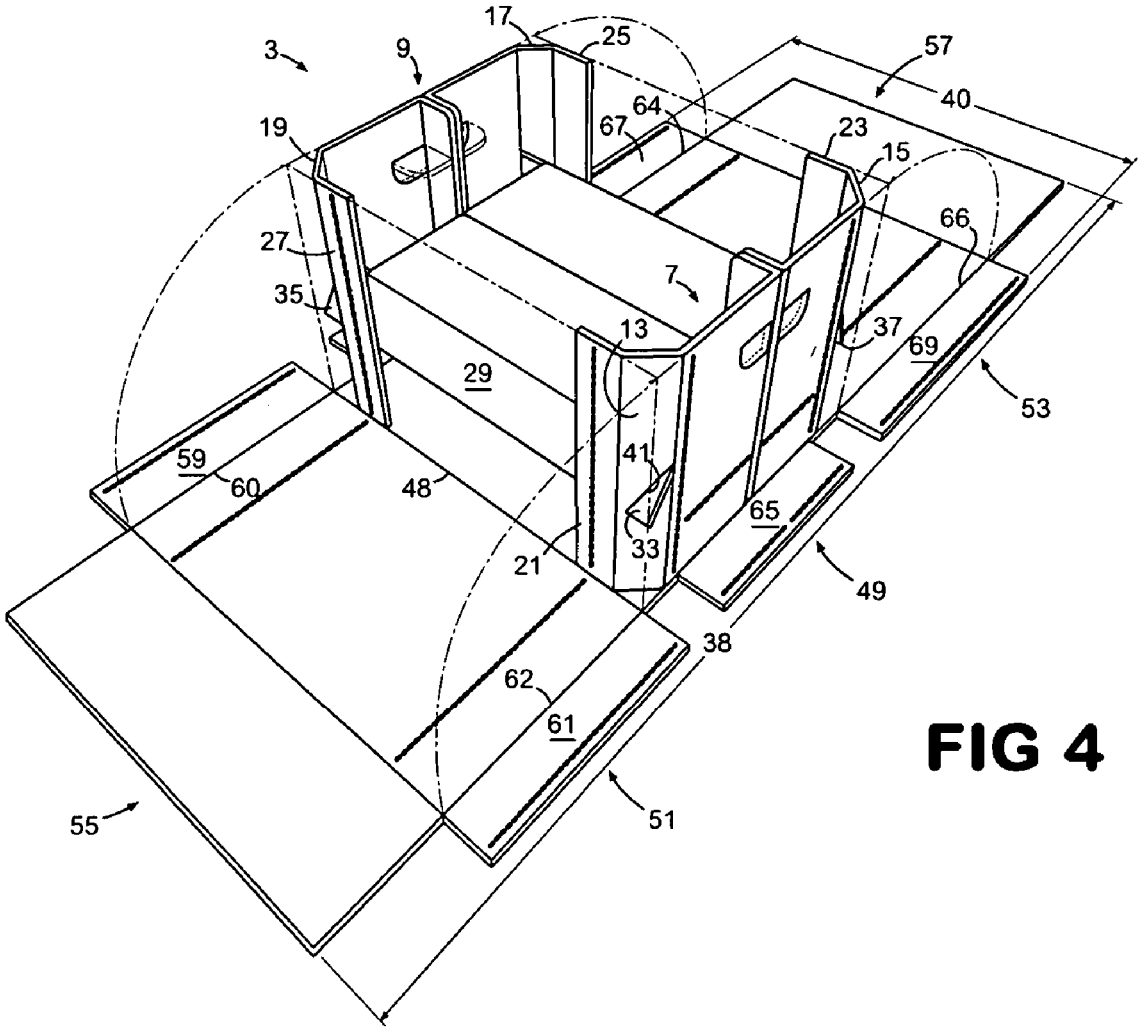
FIG. 4 is a perspective view of the load-bearing divider shelf, shown in FIG. 2, placed on top of the wrap-around closure blank, shown in FIG. 3.

FIG. 4 is a perspective view of the load-bearing divider shelf 3, shown in FIG. 2, placed on top of the bottom panel 49 of wrap-around closure 5, shown in FIG. 3. The products to be packaged are first placed on the bottom panel 49 of the wrap-around closure 5 below the divider shelf 11 and bisected by the center supports 85, 86. The side panels 51, 53 of the wrap-around closure 5 are folded at fold lines 48, 50, respectively, so that the side panels 51, 53 engage the side support flaps 21, 27, 25, 23, respectively. The strips 59, 61, 67, 69 of the side panels 51, 53 are folded at fold lines 60, 62, 64, 66, respectively, so that the strips 59, 61, 67, 69 engage the end supports 7, 9. The strips 63, 65 of the bottom panel 49 of the wrap-around closure 5 are folded at lines 56, 58, respectively, so that the strips 63, 65 engage the end supports 7, 9. The wrap-around closure 5 and the load-bearing divider shelf 3 are attached to each other by way of an adhesive bond (e.g., glue) or mechanical attachment (e.g., staples) where the wrap 5 and load-bearing divider shelf 3 make contact with each other. It should be realized that it may not be necessary to glue all of the points of contact of the load-bearing divider shelf 3 and wrap-around closure 5.

Figure 5:
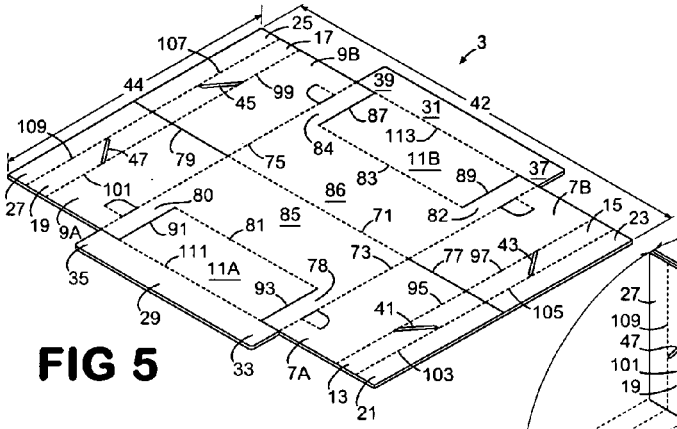
FIGS. 5-9 show pictorial diagrams illustrating the formation of the load-bearing divider shelf from blank to an erected load-bearing divider shelf as shown in FIG. 2.

FIGS. 5-9 are pictorial diagrams illustrating the formation of the load-bearing divider shelf 3 shown in FIG. 1. FIG. 5 is a perspective view of a divider blank for erecting into a load-bearing divider shelf 3. The divider blank has a length 42 and width 44. The center supports 85, 86 are foldably attached by a fold line 71 extending in a lengthwise direction 42. The leaves 11A, 11B of the divider shelf 11 are formed from a portion of the center supports and are foldably attached to the center supports 85, 86 by fold lines 81, 83, respectively. The divider leaves 11A, 11B extend at least a substantial distance of the length of the center supports 85, 86 and in a direction at least substantially parallel to the fold line 71 between the two center supports 85, 86. The divider leaves 11A, 11B are attached to locking flaps 29, 31 by fold lines 111, 113, respectively, which are generally parallel to the fold lines 81, 83. Each of the locking flaps 29, 31 has two ends, each of which has a locking tab 33, 35, 37, 39 that is capable of being locked in a locking slot 41, 47, 43, 45 on adjacent angular slot flap 13, 19, 15, 17, respectively. A fold line may be provided between each locking tab 33, 35, 37, 39 and the respective locking flap 29, 31 so the tabs 33, 35, 37, 39 can be folded after the tabs 33, 35, 37, 39 have been inserted through the respective slots 41, 47, 43, 45. It will be appreciated that this load-bearing divider shelf 3 is constructed without any gluing being necessary which saves an additional step and cost in construction of the divider.

Each of the center supports 85, 86 has two ends 78, 80, 82, 84, respectively. The ends 78, 82, 80, 84 are foldably attached to end supports 7, 9 by fold lines 73, 75, respectively. The end supports 7, 9 are attached to angular slot flaps 13, 15, 17, 19 by fold lines 95, 97, 99, 101, respectively. The angular slot flaps 13, 15, 17, 19 extend between the top and bottom of the end supports 7, 9, and have locking slots 41, 43, 45, 47 between the top and bottom of the flaps 13, 15, 17, 19, respectively.

Figure 7:
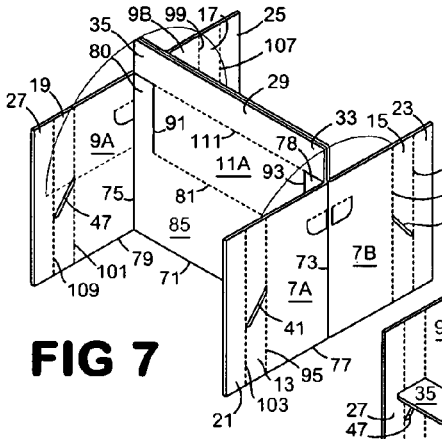
Figure 8:
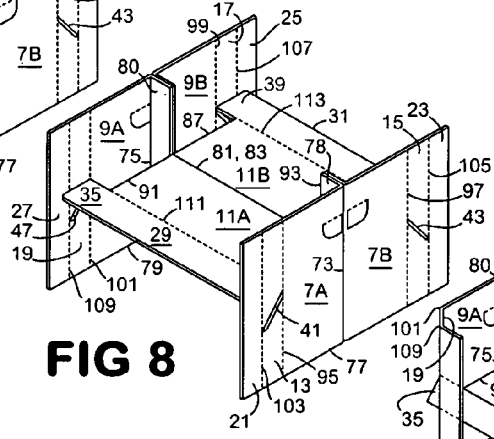

FIG. 6 shows that the divider blank is folded at fold line 71. FIG. 7 shows the splitting of the divider blank at cut lines 77, 79 and folding the divider blank at fold lines 73, 75 to form the end supports 7, 9, respectively. The end supports 7, 9 are normal to the center supports 85, 86. FIG. 8 shows the splitting of the divider blank at cut lines 91, 93, 87, 89 and folding of the divider blank at fold lines 81, 83 to form the divider shelf 11. The divider shelf 11 has two leaves 11A, 11B that are foldably attached to the center supports 85, 86 in a position normal (i.e., perpendicular) to the center supports 85, 86 by fold lines 81, 83, respectively. The leaves 11A, 11B extend at least a substantial distance of the length of the center supports 85, 86 and in a direction at least substantially parallel to the fold line 71 between the two center supports 85, 86.

Figure 9:
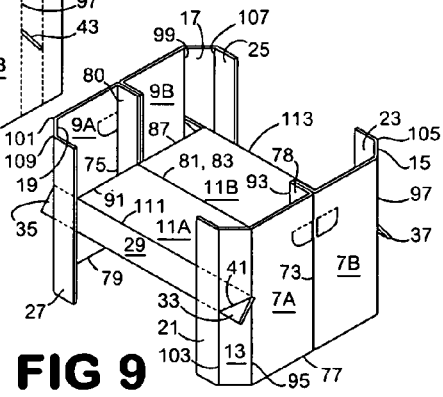

FIG. 9 shows the folding of the divider blank at fold lines 111, 113 to form the locking flaps 29, 31, respectively. The leaves 11A, 11B are foldably attached to the locking flaps 29, 31 by fold lines 111, 113, respectively, that are generally parallel to the fold lines 81, 83 between the center supports 85, 86 and leaves 11A, 11B, respectively. FIG. 9 further shows the folding of the divider blank at fold lines 95, 97, 99, 101 to form the angular slot flaps 13, 15, 17, 19, respectively, and at fold lines 103, 105, 107, 109 to form the side support flaps 21, 23, 25, 27, respectively. These side supports aid in supporting the carton. The angular slot flaps 13, 15, 17, 19 extend at an obtuse angle towards the plane of the opposing end supports 7, 9. The locking tabs 33, 35, 37, 39 of the locking flaps 29, 31 are locked into the locking slots 41, 47, 43, 45 on the angular slot flaps 13, 19, 15, 17, respectively. The locking flaps 29, 31 extend downwardly at least at substantially the same angle as the locking slots 41, 47, 43, 45 in the angular slot flaps 13, 19, 15, 17. Preferably this angle is 45 degrees.

Figure 10:
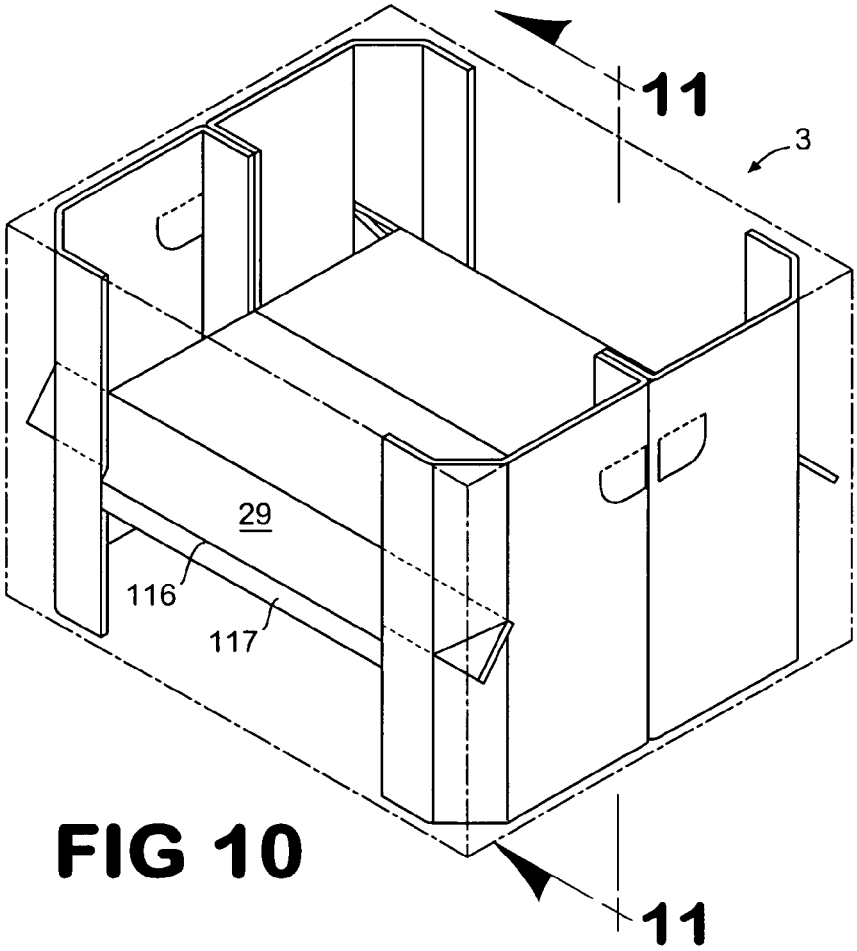
FIG. 10 is a perspective view of the load-bearing divider shelf as shown in FIG. 2 with the addition of horizontal support flaps and showing in phantom the outline of the carton.

FIG. 10 is a perspective view of the load-bearing divider shelf 3 shown in FIG. 2 with the addition of horizontal support flaps and showing in phantom the outline of the carton. The locking flaps 29, 31 are foldably attached to horizontal support flaps 117, 119 (shown in FIG. 11) by fold lines 116, 118 (shown in FIG. 11), respectively. The horizontal support flaps 117, 119 could be attached, by gluing, for example, to the side panels 51, 53, respectively, and provide additional load-bearing support for the divider shelf 11.

Figure 11:
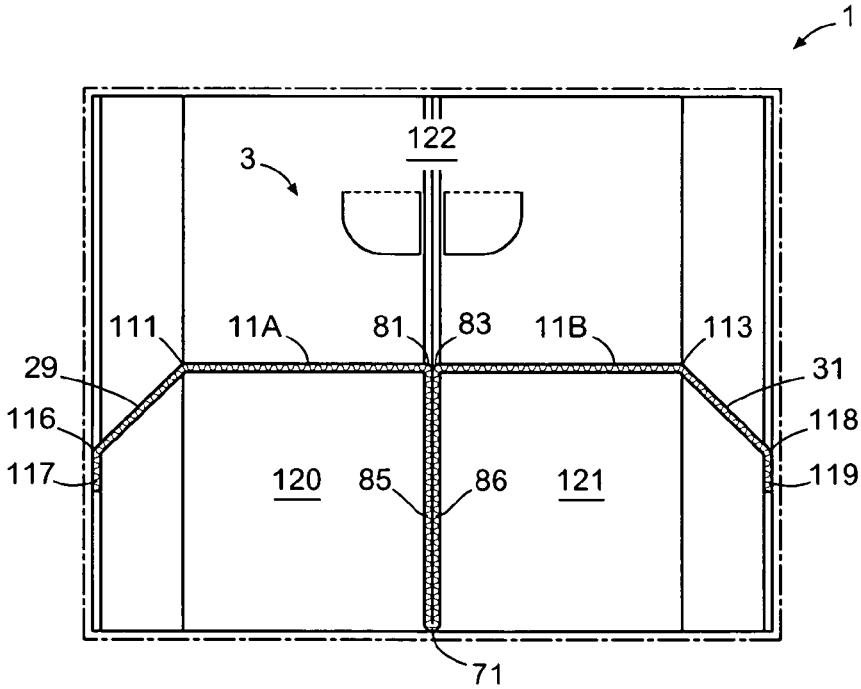
FIG. 11 is a cross-sectional view of the load-bearing divider shelf taken along line 11-11 in FIG. 10.
Figure 12:
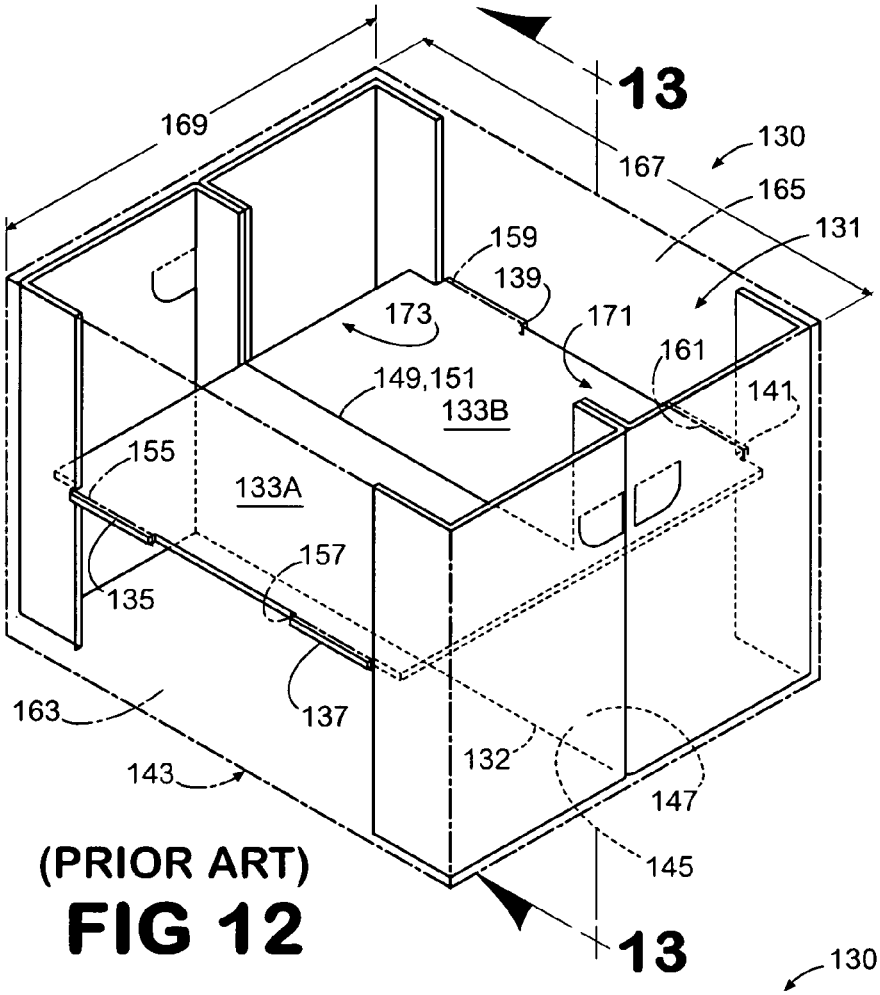
(PRIOR ART) FIG 12
FIG. 12 is a perspective view of a prior art divider shelf and showing in phantom the outline of the carton.
Figure 13:
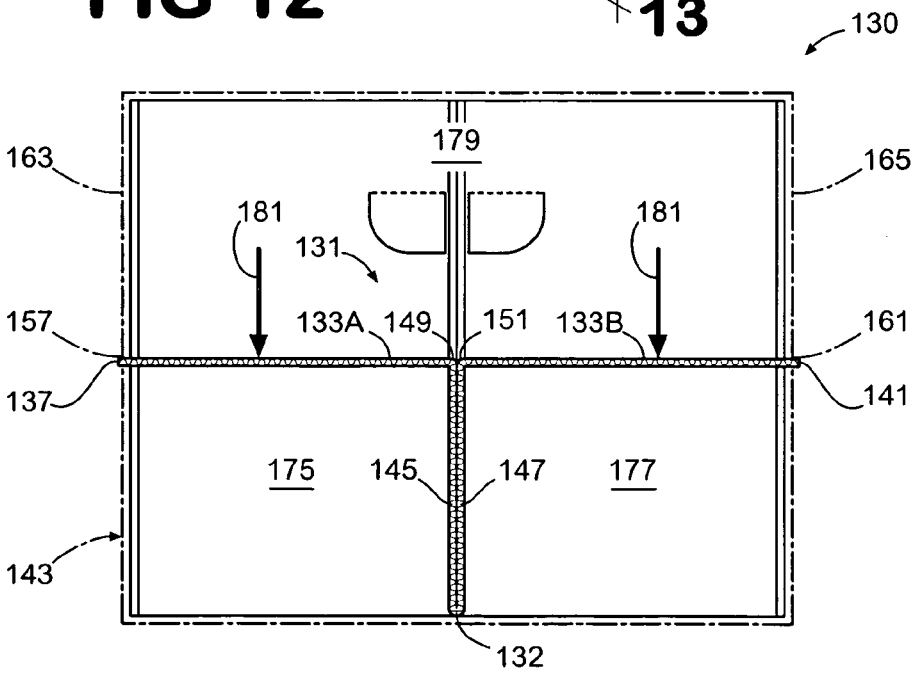
(PRIOR ART) FIG 13
FIG. 13 is a cross-sectional view of the prior art divider shelf taken along line 13-13 in FIG. 12.

FIG. 11 is a cross-sectional view of the load-bearing divider shelf 3 along line 11-11 as shown in FIG. 10. The center supports 85, 86, shelf leaves 11A, 11B, locking flaps 29, 31, and horizontal support flaps 117, 119 are formed by folding fold lines 71, 81, 83, 111, 113, 116, 118, respectively. The center supports 85, 86 bisect the lower portion of the carton 1 into two lower compartments 120, 121 and the shelf leaves 11A, 11B form an upper compartment 122.

It should be emphasized that the above-described embodiments of the present invention, particularly, any "preferred" embodiments, are merely possible examples of implementations, set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

The invention claimed is:

1. A divider blank for erecting into a load-bearing divider shelf for use in a carton, said divider blank having a length and width and comprising:

a. two center supports which are foldably attached by a fold line extending in a lengthwise direction, with each center support having two ends, with each end being foldably attached to an end support which has a top and bottom and which is foldably attached to an angular slot flap by a fold line extending between the top and bottom of the end support, with each angular slot flap having a locking slot that extends downwardly at an angle from the fold line extending between the top and bottom of the end support; and b. a shelf with two leaves, with each leaf being foldably attached to each center support by a fold line that extends at least a substantial distance of the length of the center support and in a direction at least substantially parallel to the fold line between the two center supports, with each leaf being foldably attached to a locking flap with two ends.

2. The divider blank of claim 1, in which the locking slot is formed in the mid-section between the top and bottom of the angular slot flap and a locking tab is located on each end of the locking flap.

3. The divider blank of claim 2, in which a side support flap is foldably attached to each angular slot flap.

4. The divider blank of claim 2, in which a horizontal support flap is foldably attached to the locking flap.

5. The divider blank of claim 3, in which a horizontal support flap is foldably attached to the locking flap.

6. The divider blank of claim 2, in which each leaf is formed from a portion of a center support.

7. A load-bearing divider shelf for use in a carton, said divider shelf having a length and width and comprising:

a. two coextensive center supports which are foldably attached by a fold line extending in a lengthwise direction, with each center support having two ends, with each end being foldably attached to an end support which is normal to the center support, with the end support having a top and bottom and which is attached to an angular slot flap by a fold line extending between the top and bottom of the end support, with the angular slot flap extending at an obtuse angle towards the plane of the opposing end support, with each angular slot flap having a locking slot in the mid-section between the top and bottom of the angular slot flap extending downwardly at an angle from the fold line between the end support and the angular slot flap; and b. a shelf with two leaves, with each leaf attached to each center support in a position normal to the center support by a fold line that extends at least a substantial distance of the length of the center support and in a direction at least substantially parallel to the fold line between the two center supports, with each leaf being attached to a locking flap by a fold line generally parallel to the fold line between the center support and the shelf, said locking flap having two ends, each of which has a locking tab which is locked in the locking slot on the adjacent angular slot flap.

8. The load-bearing divider shelf of claim 7, in which a side support flap is foldably attached to each angular slot flap and a horizontal support flap is foldably attached to each locking flap.

9. The load-bearing divider shelf of claim 8, in which the locking flap extends downwardly at least at substantially the same angle as the locking slots in the angular slot flaps.

10. The load-bearing divider shelf of claim 7, in which each leaf is formed from a portion of a center support.

11. The load-bearing divider shelf of claim 9, in which each leaf is formed from a portion of a center support.

12. A carton with three compartments comprising:

a. a load-bearing divider shelf for forming three compartments, said shelf having a width and length with two coextensive center supports which are foldably attached by a fold line extending in a lengthwise direction, with each center support having two ends, with each end being foldably attached to an end support which is normal to the center support with the end support having a top and bottom and which is attached to an angular slot flap by a fold line extending between the top and bottom of the end support, with the angular slot flap extending at an obtuse angle towards the plane of the opposing end support, with each angular slot flap having a locking slot in the mid-section between the top and bottom of the angular slot flap extending downwardly at an angle from the fold line extending between the top and bottom of the end support, with a shelf leaf attached to each center support in a position normal to the center support by a fold line that extends at least a substantial distance of the length of the center support and in a direction at least substantially parallel to the fold line between the two center supports, with each leaf being attached to a locking flap by a fold line generally parallel to the fold line between the center support and the leaf, said locking flap having two ends, each of which has a locking tab which is locked in the locking slot on the adjacent angular slot flap; and b. a wrap-around closure enclosing the divider shelf to form a carton, said closure comprising a bottom panel, top panel and two side panels, each of which is interconnected with the bottom and top panels, said wrap-around closure having a length extending through all of the panels and a width, the length of the closure extending around the divider shelf in the same direction as the width of the divider shelf, the length and width of the wrap-around closure being sufficient to at least substantially enclose the divider shelf.

13. The carton of claim 12, in which one of the panels of the wrap-around closure is formed from two flaps.

14. The carton of claim 13, in which a plurality of strips are foldably attached to the wrap-around closure and glued to the divider shelf to secure the closure in place enclosing the divider shelf.

15. The carton of claim 14, in which a side support flap is foldably attached to each angular slot flap and a horizontal support flap is foldably attached to each locking flap, with the locking flap extending downwardly at least at substantially the same angle as the locking slots in the angular slot flaps.

16. The carton of claim 14, in which each leaf of the divider shelf is formed from a portion of a center support.

17. The carton of claim 16, in which a handle is formed in the end supports of the divider shelf.

* * * * *